US006918709B2

(12) United States Patent
Takeuchi et al.

(10) Patent No.: US 6,918,709 B2
(45) Date of Patent: Jul. 19, 2005

(54) FLAT PLATEN AND IMAGE FORMING APPARATUS

(75) Inventors: Masaru Takeuchi, Handa (JP); Takatoshi Takemoto, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/766,924

(22) Filed: Jan. 30, 2004

(65) Prior Publication Data

US 2004/0183850 A1 Sep. 23, 2004

(30) Foreign Application Priority Data

Feb. 4, 2003 (JP) ..... 2003-027687

(51) Int. Cl.[7] ..... B41J 11/08

(52) U.S. Cl. ..... 400/662; 400/656; 400/642; 347/104

(58) Field of Search ..... 400/630, 633, 400/642, 656, 662; 347/104; 271/188, 209

(56) References Cited

U.S. PATENT DOCUMENTS 4,285,275 A * 8/1981 Sato ..... 101/474
5,127,752 A * 7/1992 Courtney ..... 400/342
5,820,283 A * 10/1998 Sunada et al. ..... 400/642
6,517,269 B1 * 2/2003 Scholz et al. ..... 400/656

FOREIGN PATENT DOCUMENTS

JP A 2000-109243 4/2000

* cited by examiner

*Primary Examiner*—Leslie J. Evanisko
(74) *Attorney, Agent, or Firm*—Oliff & Berridge, PLC

(57) ABSTRACT

A flat platen is provided in an image forming apparatus having a side edge detector that detects a side edge of a recording medium to be fed in a predetermined direction. The flat platen has a surface on which the recording medium to be fed is supported and is disposed facing the side edge detector. The side edge detector has a light emitting device and a light receiving device, which are disposed such as to face the recording medium. The side edge detector detects a side edge of the recording sheet while moving in a direction perpendicular to the predetermined direction to emit light from the light emitting device. In such a flat platen, an anti-reflective treatment, which reduces or prevents light led to the light receiving device from the light emitting device through the reflection on the surface, is applied to the surface of which corresponds to at least a vicinity of a side edge of a standard-size recording medium.

17 Claims, 16 Drawing Sheets

FLAT PLATEN AND IMAGE FORMING APPARATUS

BACKGROUND OF THE INVENTION

1. Field of Invention

The invention relates to a flat platen that is provided in an image forming apparatus. The invention also relates to an image forming apparatus that detects both side edges of a recording sheet being fed therein.

2. Description of Related Art

Japanese Laid-Open Patent Publication No.2000-109243 discloses a conventional inkjet recording apparatus such as a printer and a facsimile machine. (Refer to pp 4–6 and FIG. 3.) The inkjet recording apparatus has a flat platen that guides a recording sheet that is fed horizontally therein and a print head that is movable in a vertical direction relative to a sheet feed direction. In the inkjet recording apparatus, a recording sheet is fed on the flat platen and the print head, which is disposed facing the recording sheet, is moved to eject ink onto the recording sheet, thereby printing is made.

The print head is provided with a light emitting device (a light emitting diode, LED) and a light receiving device (a photo transistor) for detecting a width of a recording sheet. When light emitted from the light emitting device reflects on a recording sheet and is received at the light receiving device, a side edge of the sheet being fed parallel to the sheet feed direction is detected. With the detection of the side edge, a print start position and a print end position with respect to a scanning direction of the print head are determined.

SUMMARY OF THE INVENTION

However, according to the above conventional inkjet recording apparatus, a light beam emitted from the light emitting device reflects on the flat platen. As such, the amount of light that is received by the light receiving device may be beyond a specified amount. In this case, a position where a recording sheet does not exist may be improperly detected as the side edge of a sheet. If the side edge of the sheet is improperly detected, ink may be ejected from the print head to a position where there is no sheet. In such a case, the flat platen becomes soiled with ink and dirt is transferred on a succeeding recording sheet while passing on the platen. A consequent problem thus exists with a reduction in print quality of the inkjet recording apparatus.

The invention thus provides, among other things, a flat platen that can improve print quality and an image forming apparatus for use with the flat platen.

According to one exemplary aspect of the invention, a flat platen is used in an image forming apparatus that has a side edge detector that detects a side edge of a recording medium that is fed in a predetermined direction. The side edge detector has a light-emitting device and a light receiving device that are disposed facing the recording medium. The side edge detector detects the side edge of the recording medium while moving in a direction perpendicular to the predetermined direction in order to emit light from the light emitting device. The flat platen includes a surface that faces the recording medium and supports the recording medium thereon, and an anti-reflective treatment that reduces an amount of light, emitted from the light emitting device, that is reflected on the surface to the light receiving device. The surface is processed with the anti-reflective treatment at least in a part irradiated with the light emitted from the light emitting device.

According to the above structure, the side edge detector is driven and moved in the direction perpendicular to the direction that the recording medium is fed. The side edge detector emits light from the light emitting device, receives the light reflected on the recording medium at the light receiving device and detects a side edge of the recording medium. The surface of the flat platen that supports the recording medium facing the side edge detector is applied with the anti-reflective treatment. The light emitted from the light emitting device to the surface of the flat platen is reduced at the light receiving device through the application of the anti-reflective treatment to the surface of the flat platen. Thus, a provision that an error detection is unlikely to occur, and a side edge of a recording medium can be accurately detected is created.

BRIEF DESCRIPTION OF THE DRAWINGS

An embodiment of the invention will be described in detail with reference to the following figures, wherein.

DETAILED DESCRIPTION OF PREFERRED EMBODIMENTS

Figure 1:
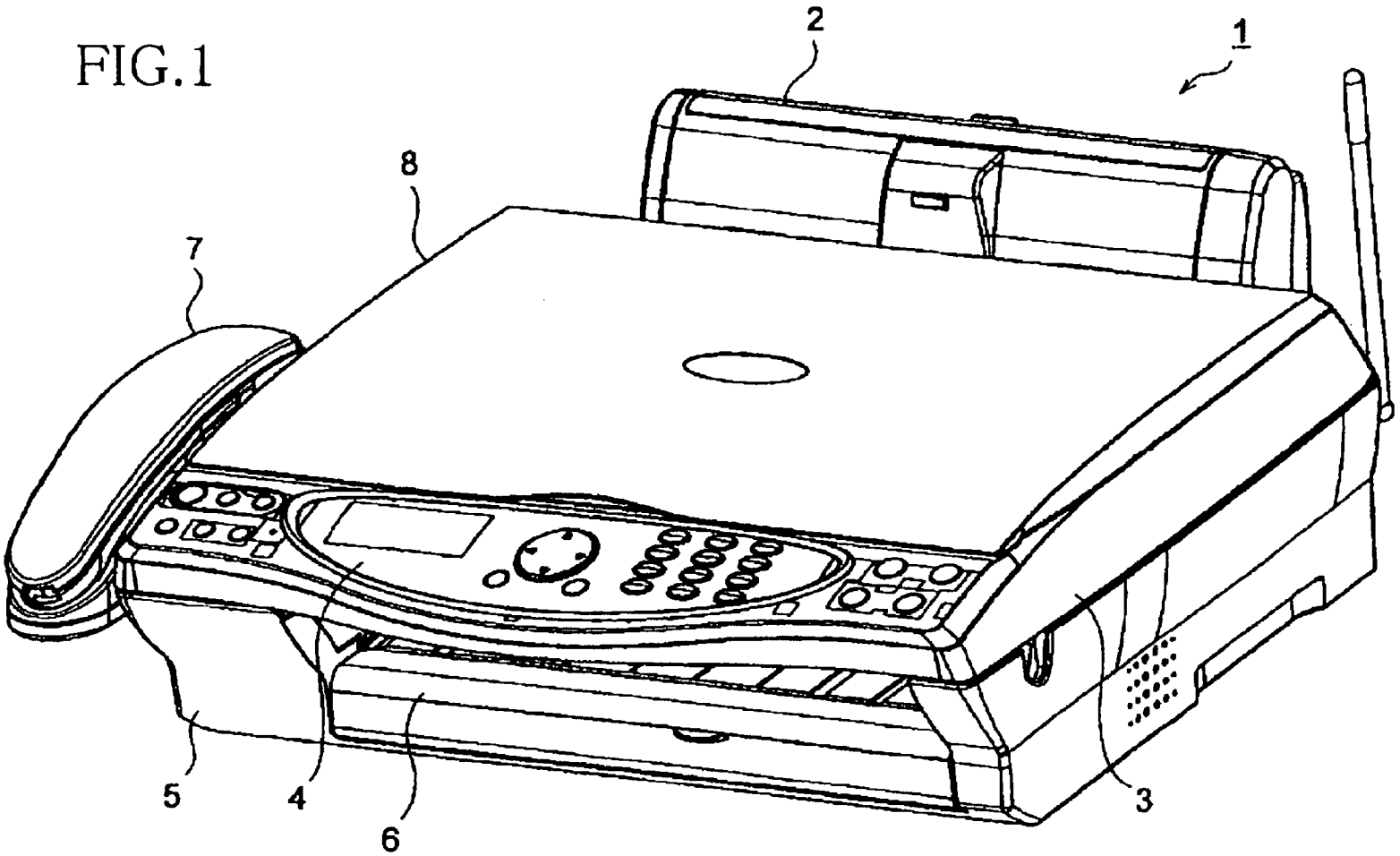
FIG. 1 is a perspective view of a multifunction device according to an embodiment of the invention.

An embodiment of the invention will be described with reference to the figures. FIG. 1 is a perspective view of a multifunction device including an inkjet recording part. The multifunction device 1 has a facsimile function, a telephone function, a copier function, a scanner function, and a printer function. The multifunction device 1 is also connectable with a personal computer.

A main body 5 of the multifunction device 1 includes a print unit 20 (FIGS. 2 and 3) having an ink cartridge (not shown), which performs printing by ejecting ink onto recording sheets such as paper and film, which are conveyed thereto. A sheet feed unit 2 that supplies recording sheets into the main body 5 is provided at the back of the main body 5. An ejection port 6 through which recording sheets printed at the print unit 20 are ejected is provided at the front of the main body 5. A handset 7 is disposed at a side of the main body 5 which enables speaking and listening by telephone.

A reading unit 3 is disposed on an upper portion of the main body 5. The reading unit 3 appears when an upper cover 8 is opened and reads an image of a document placed thereon. At the front of the reading unit 3, an operation panel 4 is disposed. The reading unit 3 is pivotally openable relative to the main body 5. By opening the reading unit 3, the print unit 20 and a path where a sheet is conveyed, which are provided in the main body 5, become accessible and sheets jammed can be removed.

Figure 2:
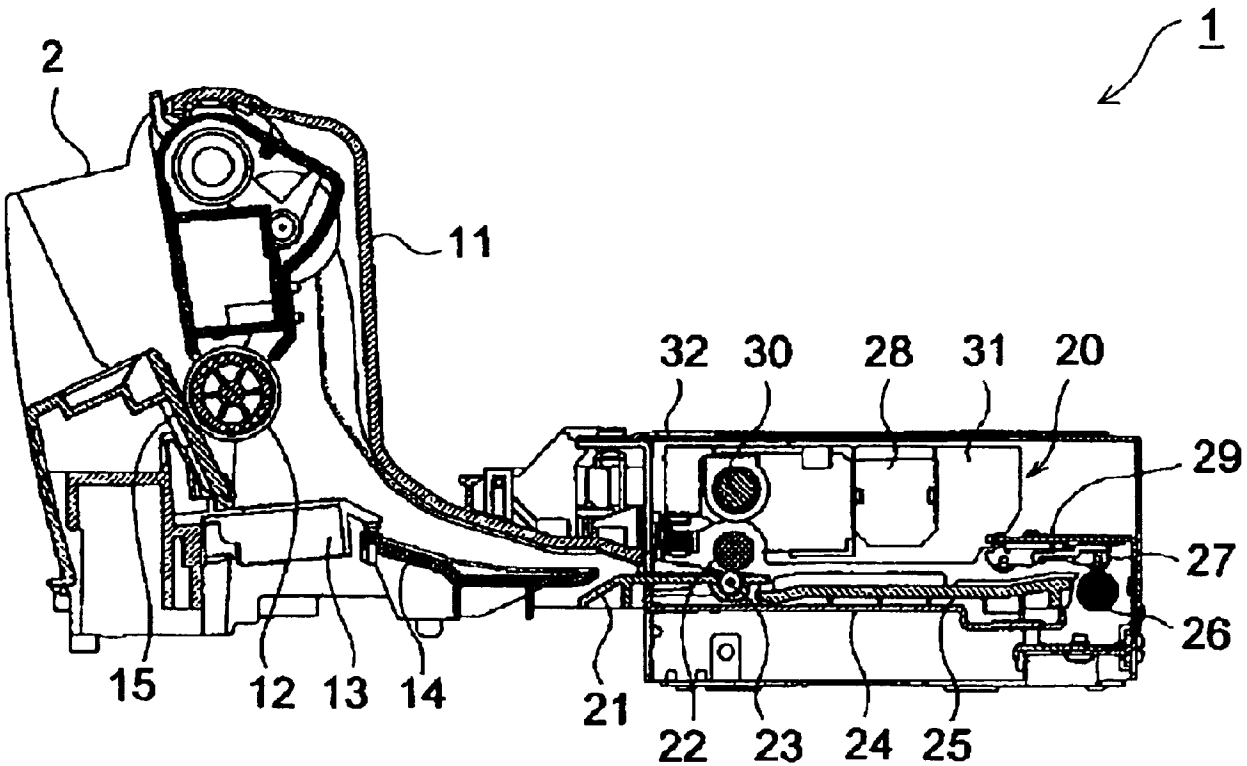
FIG. 2 is a side sectional view of the multifunction device according to the embodiment of the invention.

FIG. 2 is a sectional view showing mainly a sheet feed unit and a recording unit in the multifunction device 1. A guide plate 15 and a sheet feed roller 12 are provided in the sheet feed unit 2 covered with a sheet feed unit cover 11 at the front. The guide plate 15 guides a sheet in a sheet feed direction and supports the back of the sheet. The sheet feed roller 12 is disposed such as to have face-to-face contact with an uppermost sheet of a stack of sheets stacked on the guide plate 15. With a rotation of the sheet feed roller 12, the sheets are fed one by one from the top of the stack. Ahead of the guide plate 15, a sheet feed pad 13 that facilitates the separation of a single sheet from the stack and a chute 14 that guides the sheet separated from the stack from the sheet feed unit 2 to the print unit 20 are disposed.

The print unit 20 is made up of components, such as rollers, a platen, a print head, and drive mechanisms, which are attached to a main frame 24 that is covered with an upper frame 32 at an upper portion. A sheet being fed from the chute 14 is guided into the print unit 20 via a pressure roller holder 21 which can be inclined.

Figure 3:
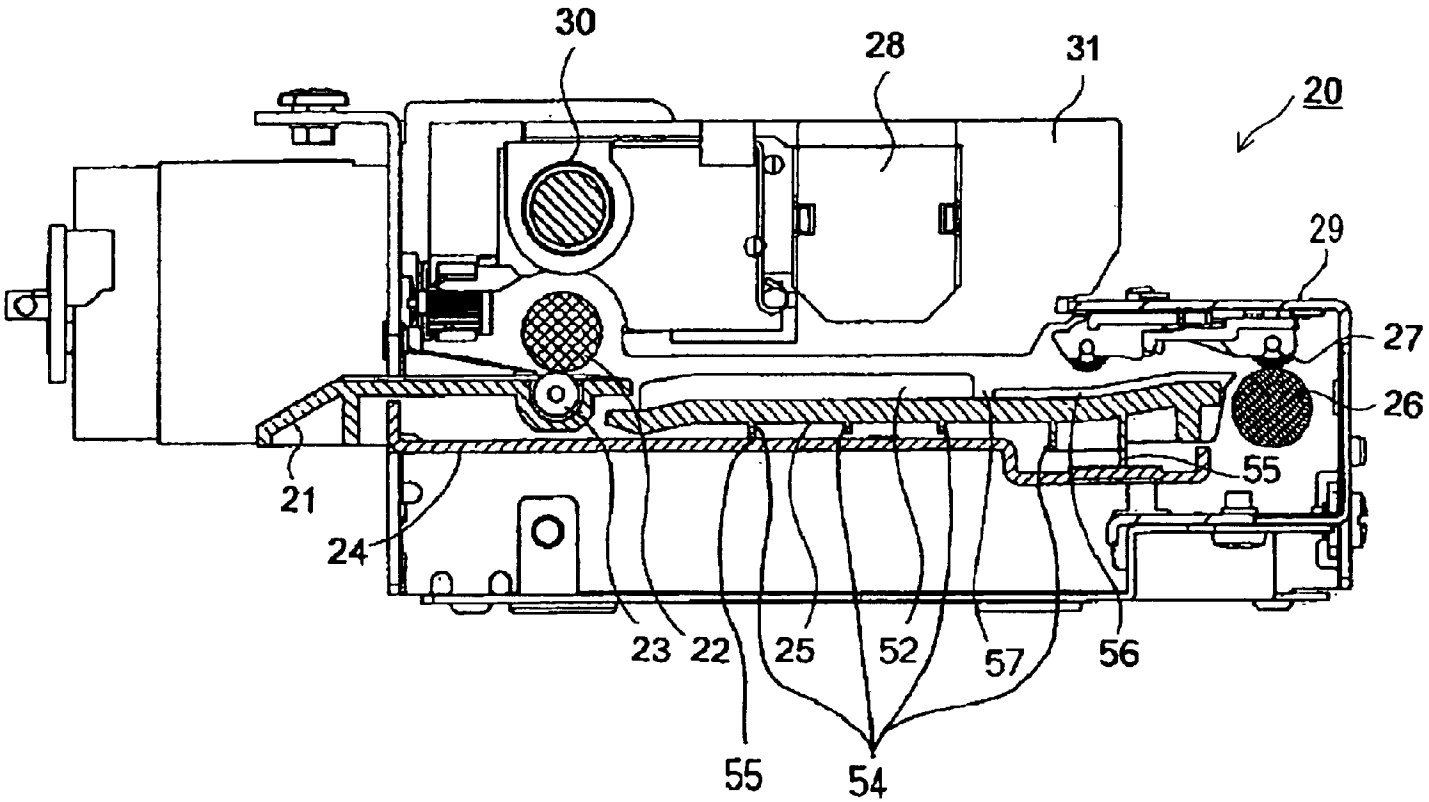
FIG. 3 is side sectional view of a print unit of the multifunction device according to the embodiment of the invention.
Figure 4:
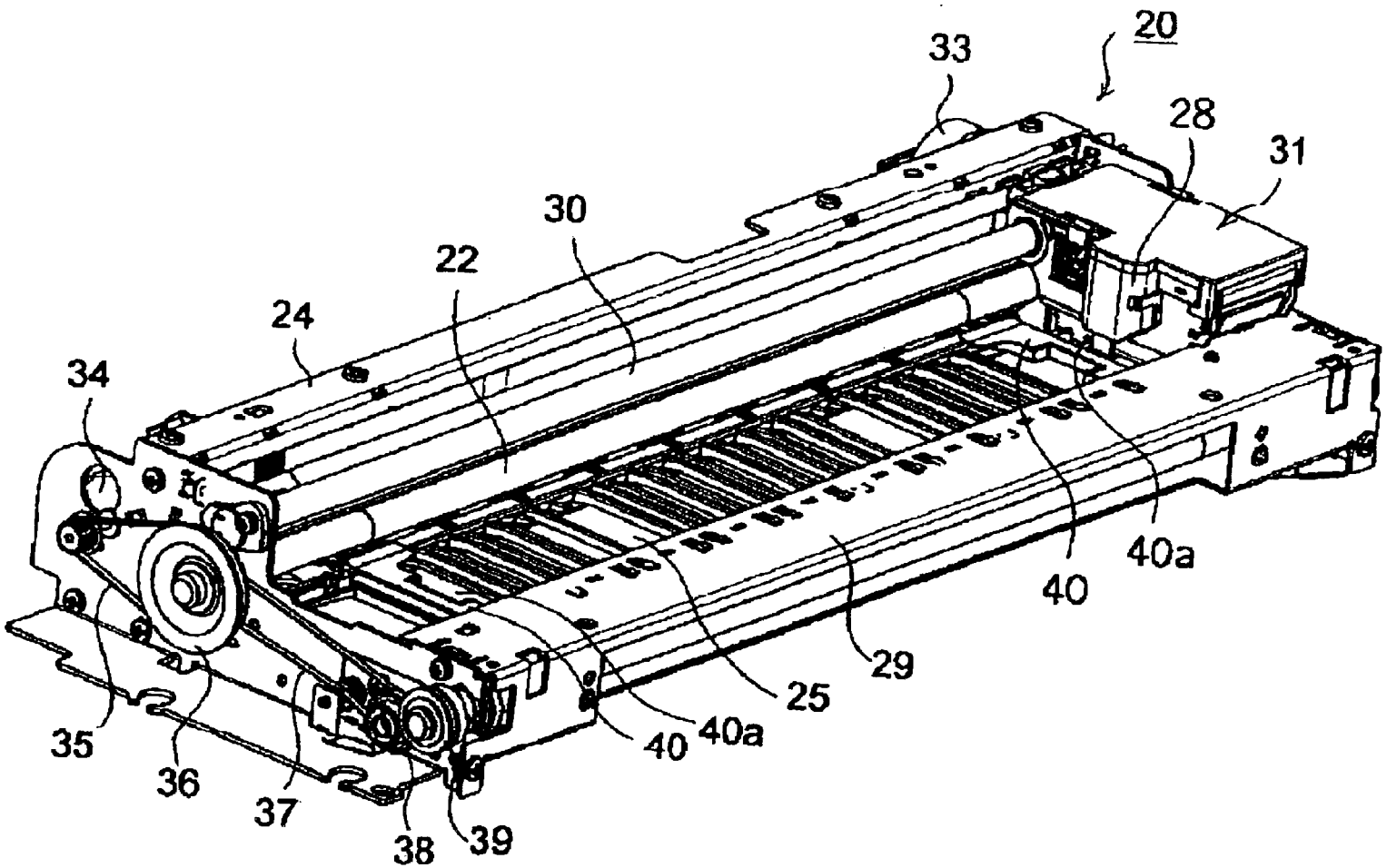
FIG. 4 is a perspective view of the print unit of the multifunction device according to the embodiment of the invention.

FIGS. 3 and 4 show a sectional view and a perspective view of details of the print unit 20, respectively. A main roller 22 and a guide shaft 30 are disposed upstream of the print unit 20 in the sheet feed direction with both ends supported by the main frame 24. The main roller 22 is disposed in contact with a pressure roller 23 supported in the pressure roller holder 21 and is driven by a sheet feeding motor 34 via a belt 35 and a speed reduction pulley 36. Thus, a sheet sandwiched between the main roller 22 and the pressure roller 23 is fed.

The guide shaft 30 guides a print head 31, which is driven by a head drive motor 33, in a direction perpendicular to the sheet feed direction. The print head 31 includes a plurality of nozzle arrays where nozzles are arranged in the sheet feed direction, and forms images by ejecting ink from the nozzle arrays. The print head 31 also includes an ink cartridge (not shown) containing ink and a media sensor 28 detecting a side edge of a sheet parallel to the sheet feed direction.

The media sensor 28 is a reflective sensor having a light-emitting device such as a light-emitting diode (LED) and a light receiving device such as a photo transistor. In the media sensor 28, a light beam is emitted from the light emitting device toward a sheet and a flat platen 25 and received at the light receiving device, thereby detecting a presence or absence of a sheet. The media sensor 28 detects both side edges of a sheet while moving along the guide shaft 30. Thus, a print start position and a print end position are determined with respect to a moving direction of the print head 31.

The flat platen 25 is disposed ahead of the pressure roller holder 21, namely, on the downstream side with respect to the sheet feed direction. The platen 25 supports a sheet to be printed at the time of printing, and guides it to the ejection port 6 (FIG. 1) horizontally after printing. At both sides of the flat platen 25, paper plates 40 made of metal are placed to adjust the position of a sheet passing on the flat platen 25.

The speed reduction pulley 36 is connected to a transmission pulley 38 via the belt 37. The transmission pulley 38 has a pulley part, which is rotated via the belt 37, and a gear part. The transmission pulley 38 is connected to an ejection gear 39 pressed in a ejection roller 26 disposed ahead of the flat platen 25, transmitting rotational force. Thereby, when the sheet feeding motor 34 is started, the ejection roller 26 is rotated.

Figure 10:
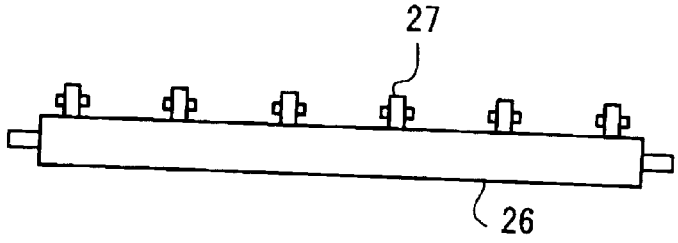
FIG. 10 is a front side view of an ejection roller and spur rollers of the multifunction device according to the embodiment of the invention.

A front frame 29 having a plurality of spur rollers 27 is attached to a front portion of the main frame 24. As shown in FIG. 10, the spur rollers 27 make contact with the ejection roller 26. The spur rollers 27 and the ejection roller 26 sandwich a printed sheet therebetween and feed it to the ejection port 6 (FIG. 1). In FIG. 10, the spur rollers 27 are drawn as if they have a thickness to some degree, but actually, they are thin plates.

The spur rollers 27 are constructed of homopolymer acetal polyoxymethylene (POM) where Teflon® is prepared. The spur rollers 27 made of resin can be manufactured reasonably compared with those of metal. The homopolymer POM can secure durability because it has higher wear resistance compared with a copolymer POM. In addition, by preparation of Teflon®, the adhesion of ink to the spur rollers 27 can be reduced. For example, Delrin AF-500® by DuPont™ can be used.

The ejection roller 26 is formed by coating a peripheral surface of a metal shaft with a urethane film having a thickness of approximately 30–35 $\mu$m. The coating of the ejection roller 25 with the thin urethane film can reduce the effects of linear expansion coefficients lower than those of a conventional ejection roller made of a thick rubber, thereby reducing a change in an outside diameter due to environmental changes, and securing a stable amount of feeding sheets. In addition, the urethane coating can reduce the wearing away of the spur rollers 27 made of resin.

Figure 5:
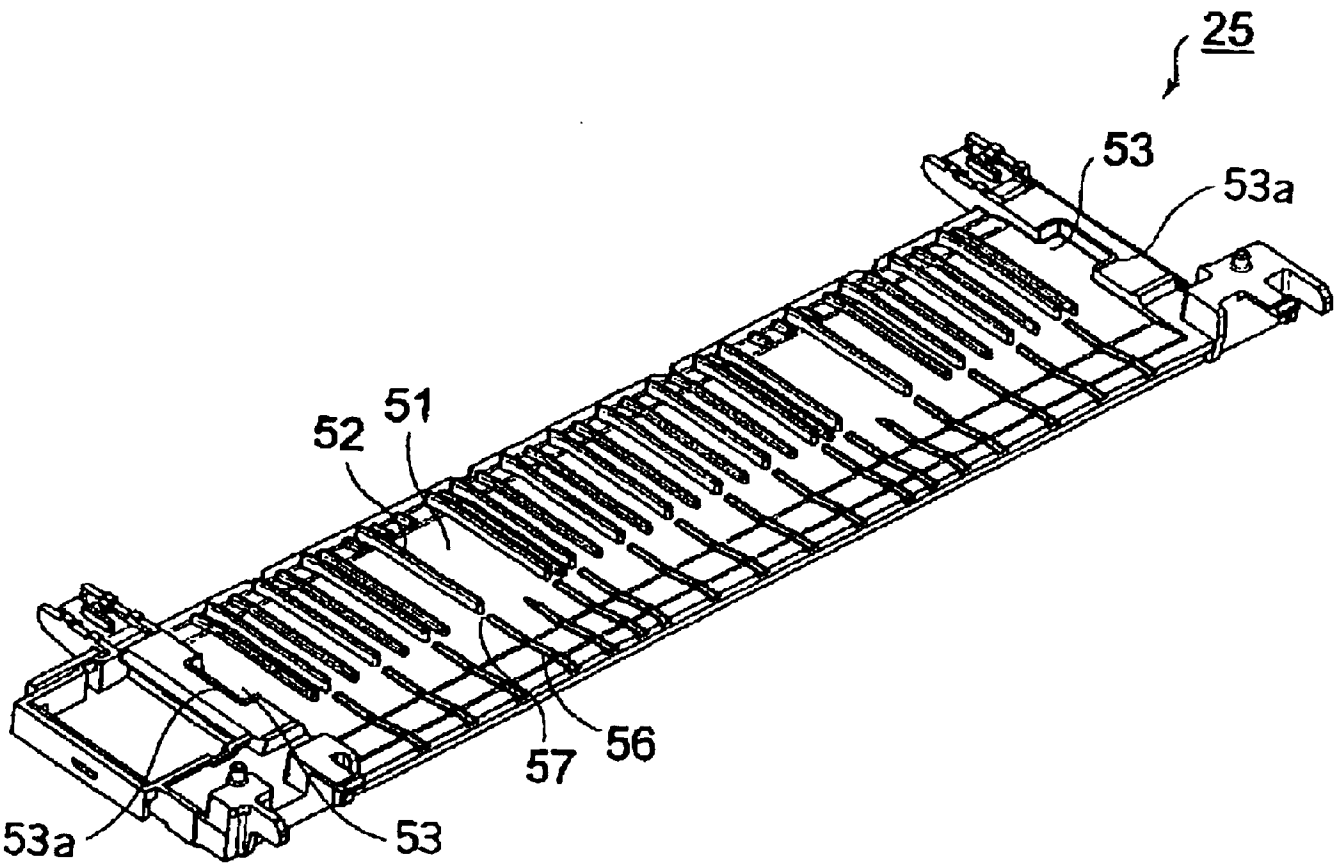
FIG. 5 is a perspective view of a flat platen of the multifunction device according to the embodiment of the invention.
Figure 6:
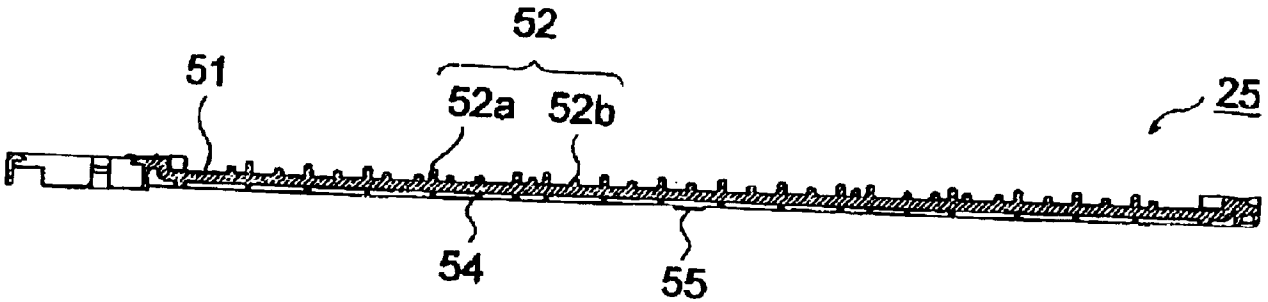
FIG. 6 is a front side view of the flat platen of the multifunction device according to the embodiment of the invention.
Figure 7:
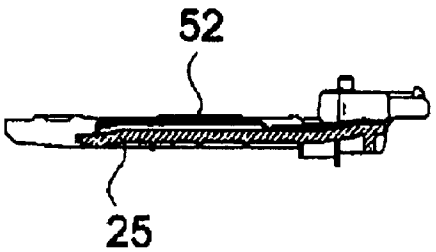
FIG. 7 is a side sectional view of the flat platen of the multifunction device according to the embodiment of the invention.

FIGS. 5, 6, and 7 show the flat platen 25 in a perspective view, a front sectional view, and a side sectional view, respectively. The flat platen 25 is a resin molded item, and a plurality of ribs 52 and 56 protrude from a surface 51 facing a sheet to be fed. Grid-type ribs 54 protrude from the back surface of the flat platen 25.

The ribs 54 ensure the strength of the flat platen 25, which is formed into a thin plate, and prevent the flat plate 25 from warping. A protrusion 55 is provided at a central portion of the back surface of the flat platen 25 with respect to a length of the flat platen 25 such as to protrude therefrom deeper than the ribs 54. The protrusion 55 makes contact with the mainframe 24 (FIG. 3) to prevent warping of the flat platen 25 due to an excessive load applied to the flat platen 25 and deterioration with time.

The ribs 52, 56, which are formed on the surface 51 of the flat platen 25, extend in the sheet feed direction and are aligned in a direction perpendicular to the sheet feed direction. A sheet fed to the flat platen 25 makes contact with the upper ends of the ribs 52, 56 and is supported thereon. The ribs 52, 56 can reduce a contact area between the flat platen 25 and the sheet, reduce friction therebetween, and facilitate feeding of the sheet.

The ribs 52 are disposed at a rear portion of the flat platen 25 (on the upstream side with respect to the sheet feed direction) and include a range (indicated by D in FIG. 8) where the media sensor 28 of the print head 31 scans. The ribs 56 are separated from the ribs 52 with a space 57, and are disposed at a front portion of the flat platen 25 (on the downstream side with respect to the sheet feed direction). The ribs 56 are lower than the ribs 52 in height. On the flat platen 25, the number of the ribs 56 is lower than that of the ribs 52. The ribs 56 are also located on lines extended from the ribs 52 with the space 57 in the sheet feed direction.

When the sheet is printed on the ribs 52, the ribs absorb ink and bows. The leading edge of the sheet bowing upward in the back and forth direction passes in the clearance 57 (FIGS. 3 and 5) to reduce bowing of the sheet and to prevent deterioration of image quality. When the leading edge of the sheet is away from a printing area, it slides on the ribs 56 which are lower in height, where bowing of the sheet in the printing area is reduced, and the sheet is fed smoothly.

Figure 8:
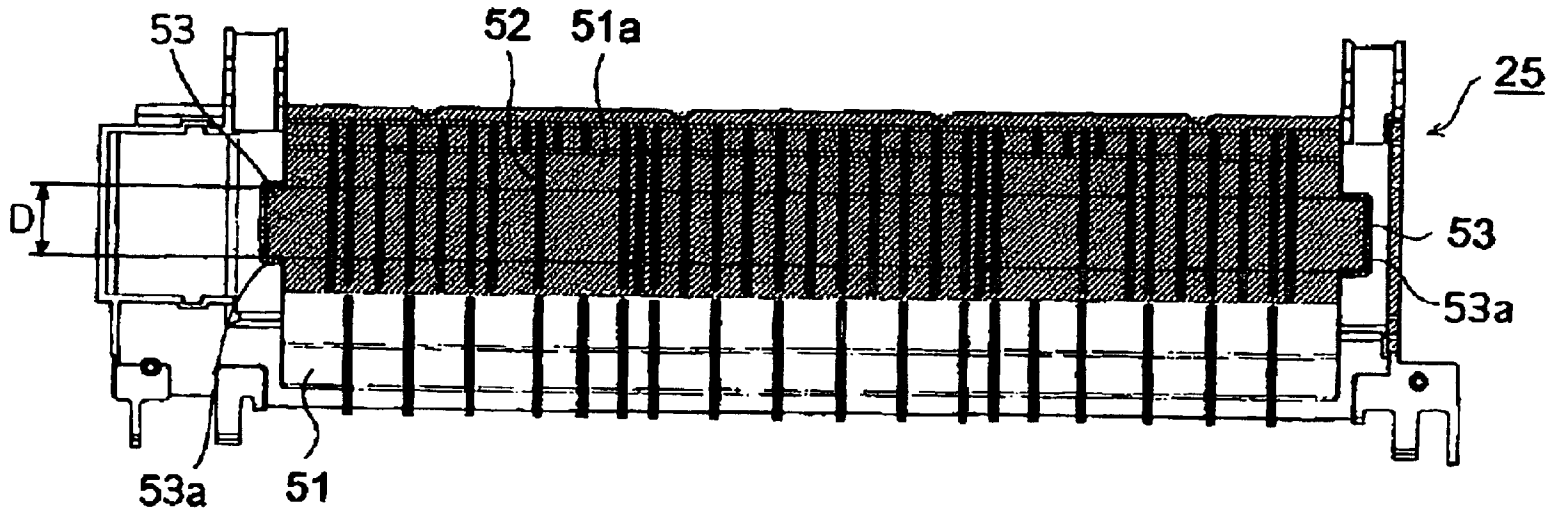
FIG. 8 is a plan view of the flat platen of the multifunction device according to the embodiment of the invention.

FIG. 8 is a plan view of the flat platen 25. An anti-reflective treatment portion 51*a*, which is given anti-reflective treatment indicated by hatching, is formed at the rear portion of the flat platen 25 and includes the scanning area D of the media sensor 28 that is on the surface 51 on the upstream side with respect to the sheet feed direction. The light emitted from the light emitting device of the media sensor 28 reflects on the flat platen 25 or a surface of a sheet being fed and goes in the light receiving device.

However, much of the light is diffusely reflected and absorbed at the anti-reflective treatment portion 51*a* of the flat platen 25. As such, the amount of the light incident on the light receiving device becomes extremely low. Thus, the light beam reflected at the flat platen 25 is reduced or prevented. On the other hand, a large amount of light reflected on the sheet is incident on the light receiving device. Thus, a control part (not shown) of the multifunction device 1 is capable of reliably detecting the presence or absence of the sheet based on the amount of light received by the media sensor 28, thereby determining both side edges of the sheet with precision.

For example, anti-reflective treatment for the anti-reflective treatment portion 51*a* may be applied by forming a dull surface with matte treatment, such as sandblasting and texturing. Texturing is a process used to apply a textured pattern to a surface of a part to be molded by making a surface of a mold rough by etching. Thus, as the matte treatment is applied concurrently with the molding of the flat platen 25, the number of processes to manufacture the flat platen 25 can be reduced. In this embodiment, HM3013 (matte finish pattern) of Nihon-Etching Co., LTD. is used as a textured pattern.

By applying matte treatment to the scanning area D of the media sensor 28, light emitted from the light emitting device of the media sensor 28 is diffusely reflected at the anti-reflective treatment portion 51*a*. With this structure, the amount of light that is reflected on the surface 51 and received on the light receiving device is reduced, thereby relieving a detection error of the media sensor 28 at a position where no recording sheet exists. Namely, the precision of the media sensor 28 that detects both side edges of a sheet can be improved. As a result, a positioning accuracy of the print start position and the print end position in the moving direction of the print head 31 can be improved.

The paper plates 40 (FIG. 4) disposed on both ends of the flat platen 25 serve to prevent a recording sheet from going up toward the print head 31 and guide the recording sheet onto the flat platen 25. The paper plates 40 are in the form of a thin metal to be placed in a narrow area between the print head 31 and the flat platen 25. The paper plates 41 are formed with recesses 40*a* (FIG. 4) in the scanning area D of the media sensor 28 to block the reflection of light emitted from the light emitting device. The flat platen 25 is formed with recesses 53 at positions corresponding to the recesses 40*a*, and matte treatment is applied to side walls defining the recesses 53. Thereby, the reflection of light at both ends of the flat platen 25 can be controlled.

Ribs 53*a* are disposed along the shape of the recesses 53 of the flat platen 25 at positions corresponding to the recesses 40*a*, so that the edges of the paper plates 40 are covered with the ribs 53*a*. This structure can prevent the media sensor 28 from making an improper detection of both side edges of a sheet which may occur when a light beam emitted from the light emitting device of the media sensor 28 is reflected at an edge of either paper plate 40 and received at the light receiving device. With the application of the anti-reflective treatment such as matte treatment to the ribs 53*a*, an effect on the prevention of the improper detection can be improved.

Figure 11:
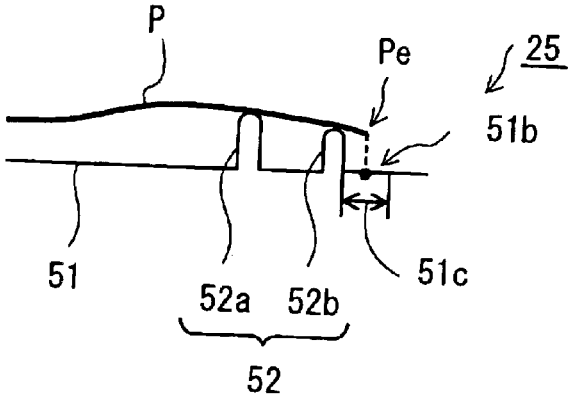
FIG. 11 is a front side view of essential parts of the flat platen of the multifunction device according to the embodiment of the invention.

It is preferable that the anti-reflective treatment portion 51*a* is provided in a place that corresponds to at least a vicinity of each side edge of a lower part of a standard-size sheet. As shown in FIG. 11, this position is in an area 51*c* of the flat platen 25 including a position 51*b* vertically extending downward from a side edge Pe of a sheet P.

Figure 9:
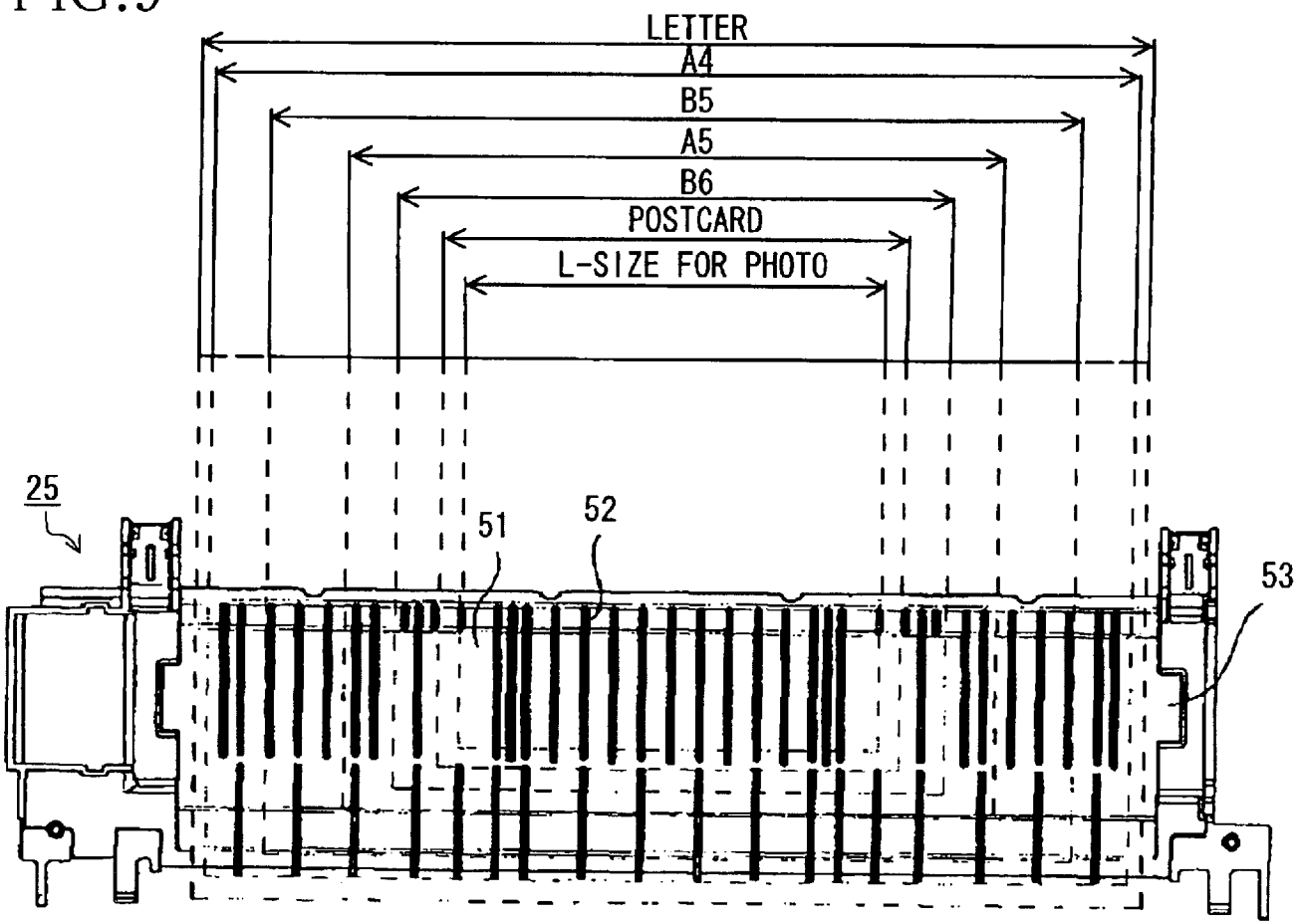
FIG. 9 is a plan view of the flat platen of the multifunction device according to the embodiment of the invention.

The standard size for recording sheets includes letter size, A4 size, B5 size, A5 size, B6 size, postcard size, and L-size for photo, as shown in FIG. 9, which are specified by JIS Standards and North American standards. If the multifunction device 1 is a large-sized one, B4 size and A3 size are also available.

When the anti-reflective treatment portion 51*a* is formed in close vicinity to both side edges of a standard size sheet on the reverse side, the positioning accuracy of the print head 31 can be improved while a recording sheet of a standard size often used is printed. At this time, a range to form the anti-reflective treatment portion 51*a* can be determined depending on variations in positioning during the feeding of sheets and the sensitivity of the light receiving device.

For example, the anti-reflective treatment portion 51*a* may be provided in an area falling within at least 2 mm outside or inside with respect to both side edges of a sheet of each standard size to be disposed, in terms of design specification. Thus, an error in detecting both side edges can be prevented even when there is a positioning variation of a recording sheet.

If matte treatment is applied to the top surfaces of the ribs 52 where the sheet slides, the friction force of the ribs 52 with the sheet increases, and the sheet is not smoothly fed.

For this reason, it is easy for the top surfaces of the ribs 52 to reflect light. As shown in FIG. 9, the ribs 52 are arranged such that the top surfaces of the ribs 52 are not positioned directly under both side edges of any standard size sheets. Thus, light that is reflected on the top surfaces of the ribs 52 and received at the light receiving device is reduced, thereby improving the positioning accuracy of the print start position and the print end position in the moving direction of the print head 31 while the sheet of any standard size often used is printed.

If the ribs 52 are arranged close to the outside from both side edges of a standard-size sheet, light that is emitted from the light emitting device and reached at the ribs 52 may be received at the light receiving device due to the variations in positioning of sheets being fed and the sensitivity of the light receiving device. Thus, it is preferable not to provide the ribs 52 within 2 mm outward from positions directly below both side edges of any standard-size sheet.

The ribs 52 have a height of 2 mm or more. Thus, the amount of light reflected on the surface 51 and received at the light receiving device can be reduced. It is preferable to form the anti-reflective treatment portion 51*a* treated with either of the above mentioned methods on the surface 51 and set the height of the ribs 52 to 2 mm or more.

As shown in FIG. 6, the ribs 52 are made up of two kinds of ribs 52*a* and 52*b* of different heights. The ribs 52*a* and 52*b* are disposed in parallel to each other in a direction perpendicular to the sheet feed direction. The high ribs 52*a* make sliding contact with and guides a recording sheet being printed. The low ribs 52*b* hold the sheet that has absorbed ink during printing and that bows in a vertical direction relative to the sheet feed direction such as not to contact with the surface 51. With this structure, the sheet can be prevented from bowing thereby obtaining high print quality.

When a side edge of a sheet is brought in contact with the surface 51 due to its bending, ink smudges the surface 51 and adheres to the sheet. Thus, as shown in FIG. 11, the low rib 52*b* is disposed inside from the side edge Pe of the sheet P, and the side edge of the sheet is raised to prevent ink from staining on the surface 51.

Figure 16:
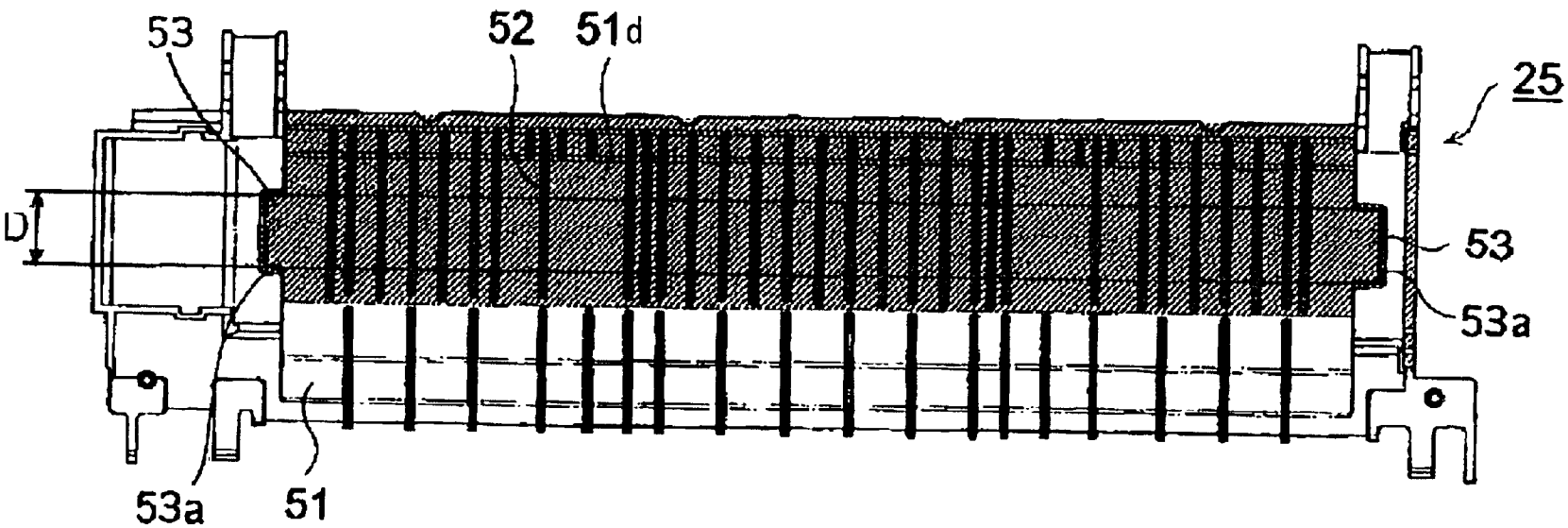
FIG. 16 is a plan view of the flat platen of the multifunction device according to the embodiment of the invention.

A purpose of the anti-reflective treatment portion 51*a* provided in the scanning area D of the media sensor 28 is to enable a provision that reduces or prevents light that is emitted from the light emitting device of the media sensor 28, to reflect off of the flat platen 25 and to be received by the light receiving device. Thus, a light absorbent member 51*d* (FIG. 16) in the form of sheet may be affixed onto the surface 51 instead of the above-described matte treatment. Thus, a light beam emitted from the light emitting device is absorbed by the light absorbent member, so that the reflection of the light beam can be reduced.

Figure 17:
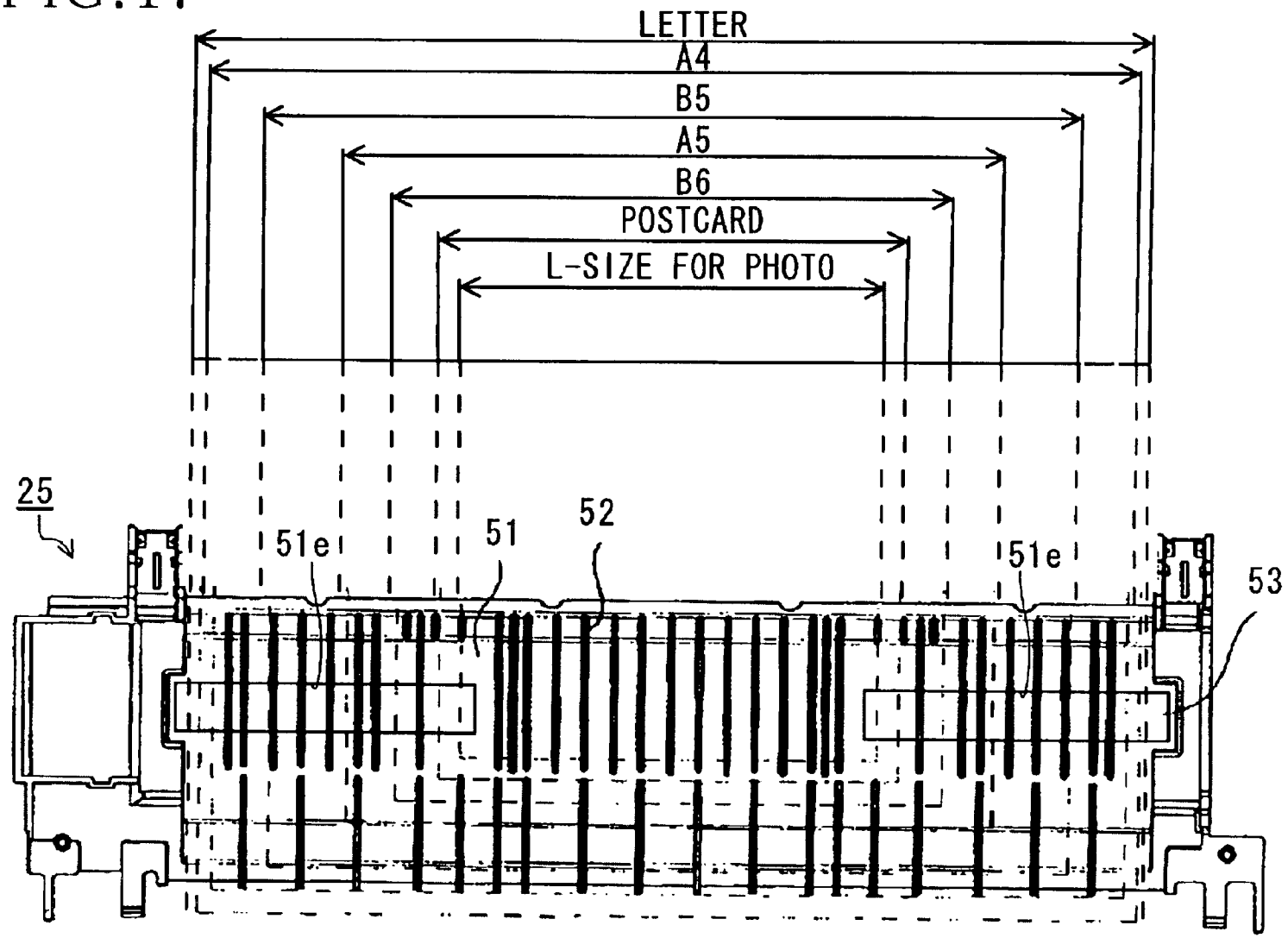
FIG. 17 is a plan view of the flat platen of the multifunction device according to the embodiment of the invention.

Instead of the matte treatment or the affixture of the light absorbent member, openings 51*e* (FIG. 17) may be formed on the flat platen 25 in the vicinity of both side edges of a sheet of a standard size, which is to be fed. Thus, in printing the sheet of a standard size, light emitted from the light emitting device can pass through the openings to prevent light reflection at the flat platen 25.

Figure 12:
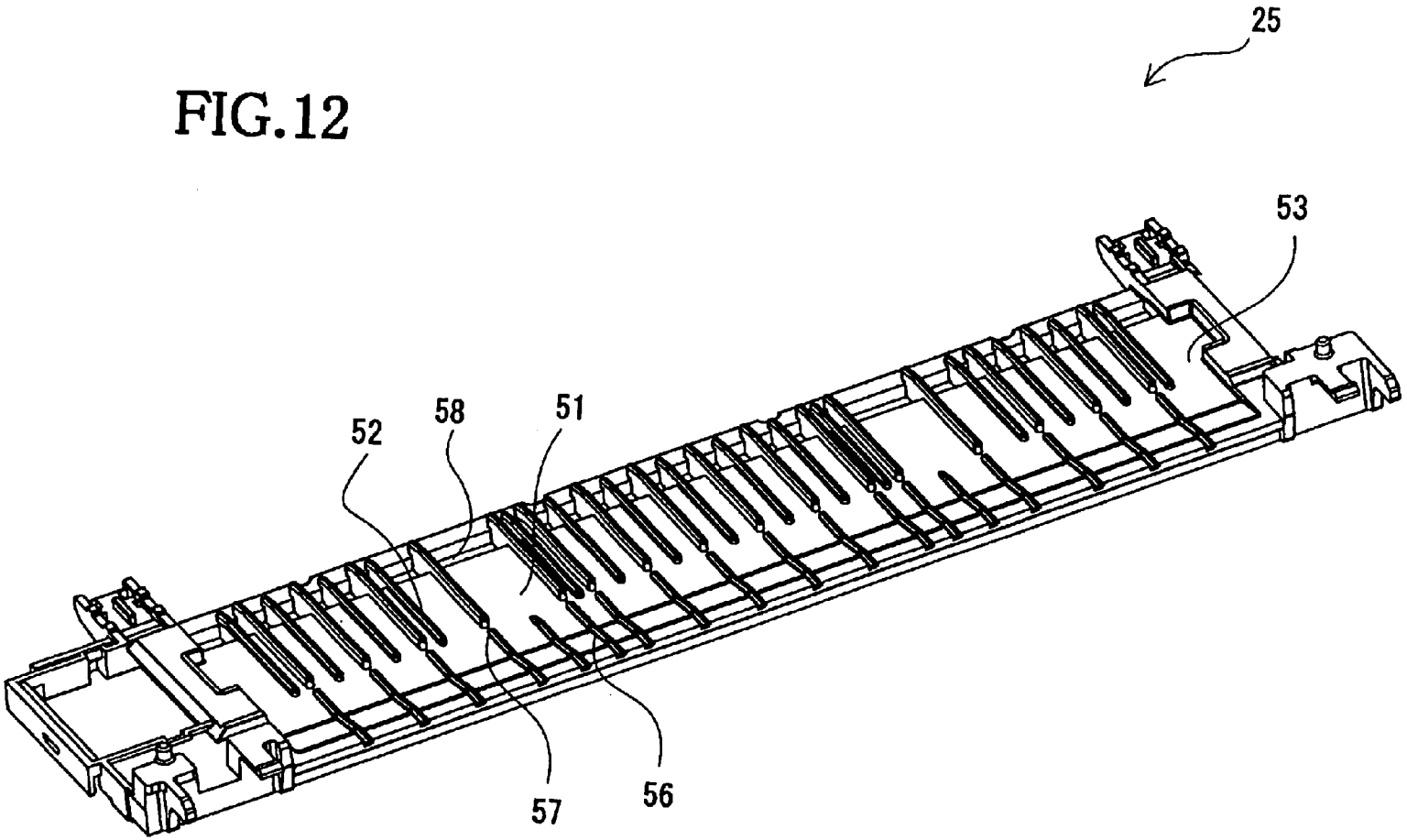
FIG. 12 is a perspective view of a flat platen for use with a multifunction device according to a modification of the embodiment.
Figure 13:
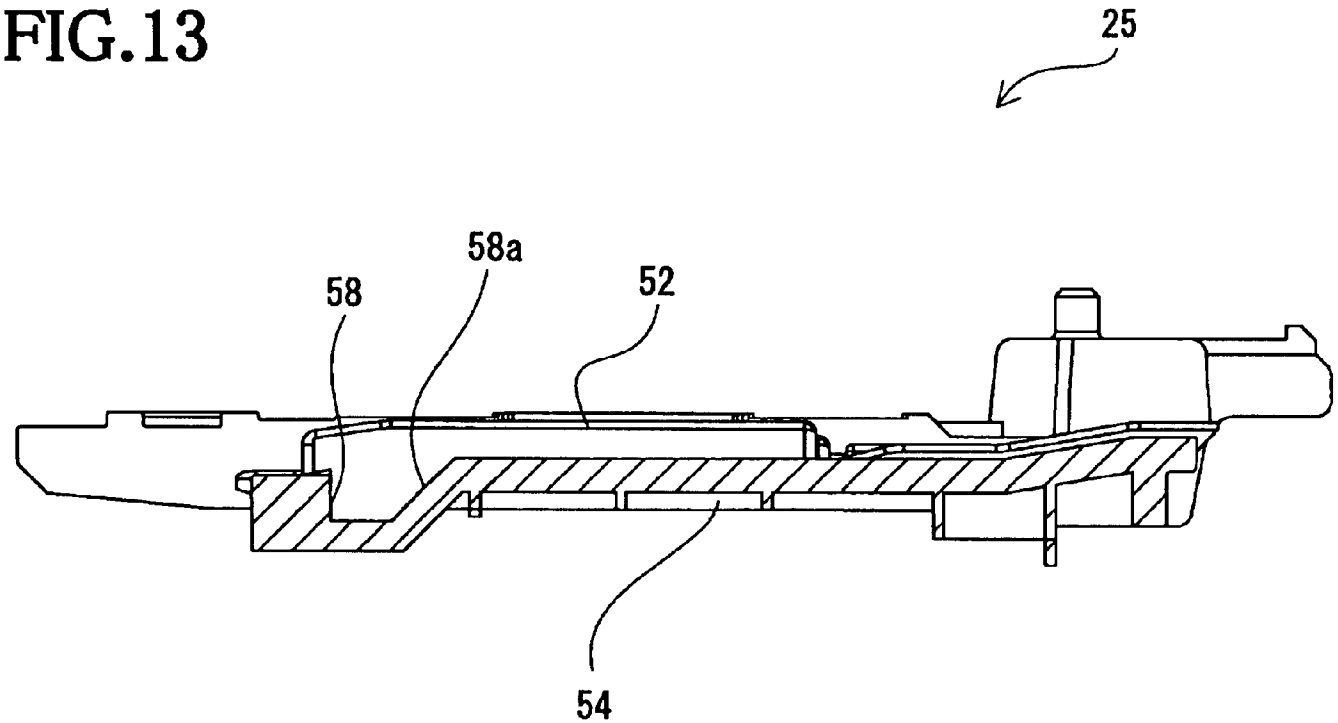
FIG. 13 is a side sectional view of the multifunction device according to the modification of the invention.
Figure 14:
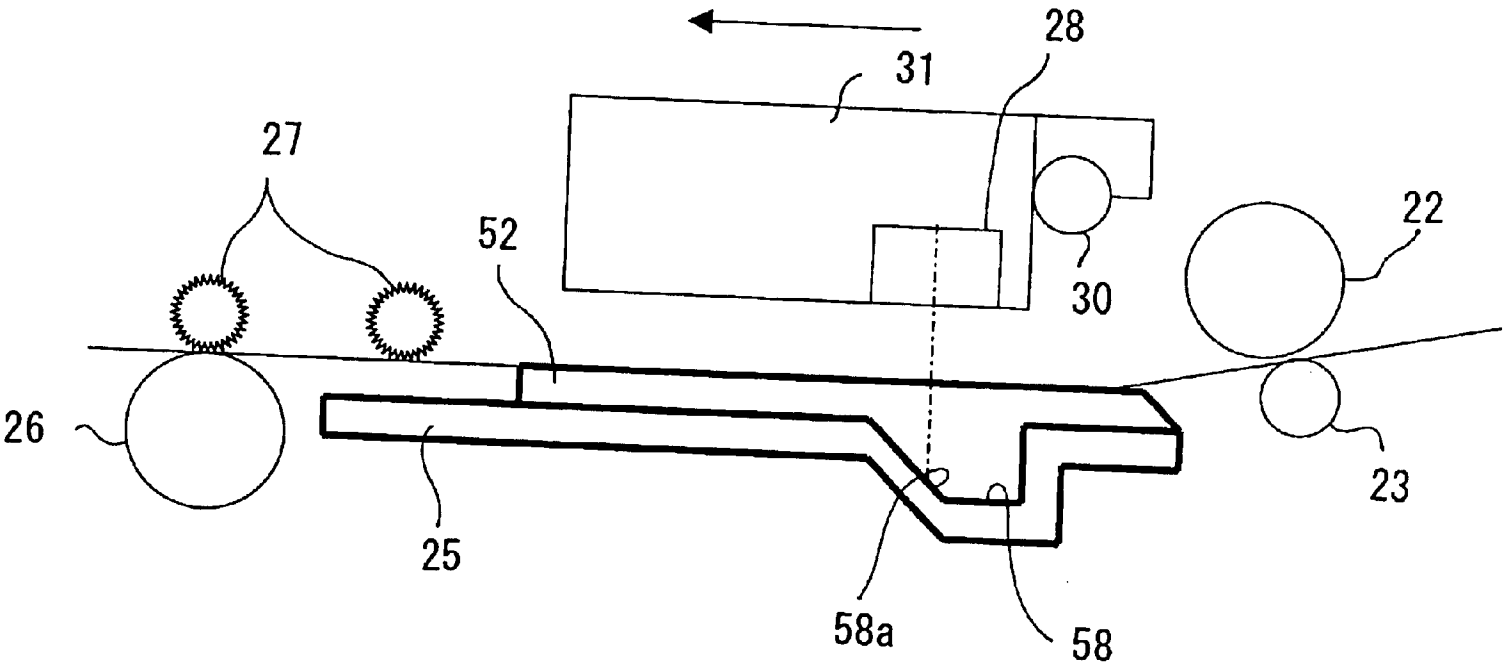
FIG. 14 is a schematic diagram showing a positional relationship between the flat platen and a media sensor of the multifunction device according to the modification of the invention.

Additionally, instead of the matte treatment or the affixture of the light absorbent member, the flat platen 25 may be provided with a groove portion 58 including an inclined plane 58*a*, which extends in a direction perpendicular to the sheet feed direction in the scanning area of the media sensor 28, as shown in FIGS. 12 to 14. The inclined plane 58*a* is disposed in an area irradiated with light from the light emitting device of the media sensor 28, and formed to incline toward the sheet feed direction. The inclined plane 58*a* has a width of 2 mm to 10 mm and is designed such that an angle between the inclined plane 58*a* and incident light from the light emitting device of the media sensor is 20° to 70°. In the illustrated flat platen 25, for example, the inclined plane 58*a* has a length of 6 mm, and the angle formed with the incident light from the light emitting device is 45°. In this form, it is preferable that the incline plane 58*a* is smooth without matte treatment or texturing.

By forming the groove portion 58 having such an inclined plane 58*a*, light that is emitted from the light emitting device of the media sensor 28 reflects on the inclined plane 58*a*. The reflected light goes to a direction completely different from a direction where the light receiving device of the media sensor 28 is present. With this formation, light reflected on the surface 51 and received by the light receiving device can be reduced, thereby relieving a detection error of the media sensor 28 at a position where no recording medium exists. Namely, the precision of the media sensor 28 detecting both side edges of a sheet can be improved. As a result, a positioning accuracy of the print start position and the print end position in the moving direction of the print head 31 can be improved.

By formation of the groove portion 58 in the flat platen 25, the strength of the flat platen 25 in the form of a thin plate is ensured, and the flat platen 25 can be prevented from bending in its longitudinal direction. Thus, in this form, the grid-type ribs 54 provided on the back side of the flat platen 25 can be omitted or replaced with ribs extending only in the sheet feed direction for simplification. Instead of the ribs 54, a plurality of groove portions extending in the direction perpendicular to the sheet feed direction may be provided on the flat platen 25 in parallel to each other in the sheet feed direction. This form also can sufficiently ensure the strength of the flat platen 25.

Figure 15:
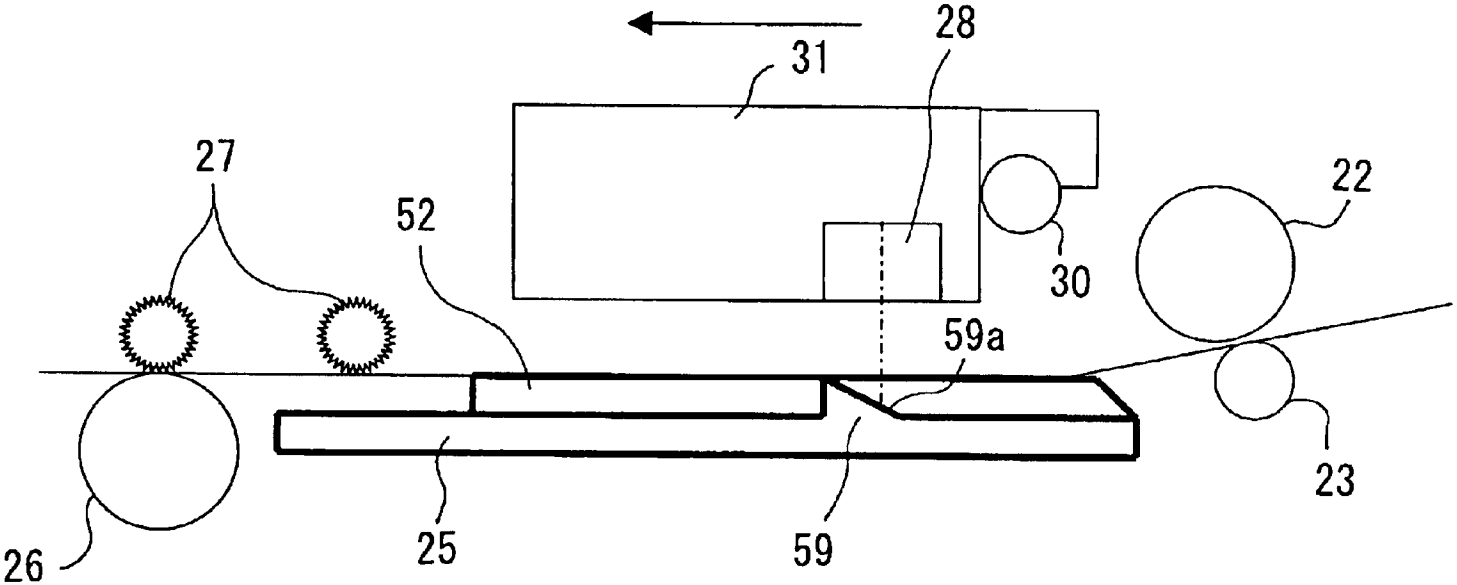
FIG. 15 is a schematic diagram showing a positional relationship between the flat platen and the media sensor of the multifunction device according to the modification of the invention.

In the above structure, the groove portion 58 including the inclined plane 58*a* is formed in the scanning area of the media sensor 28 on the flat platen 25. However, as shown in FIG. 15, a protrusion 59 including an inclined plane 59*a* may be formed in the scanning area of the media sensor 28 on the flat platen 25. The inclined plane 59*a* may be structured with the same position, the same width and the same angle of inclination as the inclined plane 58*a*, however, the protrusion 59 should be set lower than the ribs 52 in height such as not to hinder feeding of recording sheets.

While the invention has been described with reference to a specific embodiment, the description of the embodiment is illustrative only and is not to be construed as limiting the scope of the invention. Various other modifications and changes may occur to those skilled in the art without departing from the spirit and scope of the invention. For example, when the sheet sizes available on the above multifunction device 1 are shown in FIG. 9, and the smallest size is L-size for photo, the anti-reflective treatment portion 51*a*, the groove portion 58 having the inclined plane 58*a*, and the protrusion 59 having the inclined plane 59*a* may be provided, not in the area where a L-size-for-photo sheet passes, but on each side only beyond the L-size-photo sheet. When the sizes of sheets to be used can be limited, the anti-reflective treatment portion 51*a*, the groove portion 58 having the inclined plane 58*a*, and the protrusion 59 having the inclined plane 59*a* may be provided in predetermined areas having a width of approximately 2 mm to 5 mm outside from each side of the sheets.

According to the embodiment of the invention, the surface 51 of the flat platen 25 is formed with the anti-reflective treatment portion 51*a* or the inclined plane 58*a* or 59*a*, such as to reduce or prevent light that is emitted from the light emitting device and received at the light receiving device by reflection. For this reason, both side edges of a sheet can be accurately detected. Thus, the print head 31 can be positioned with high accuracy thereby providing high print quality.

Anti-reflective treatment can be easily applied to the flat platen 25 by either of matte treatment, affixture of a light absorbent member, provision of an opening, and formation of the inclined plane 58*a*, 59*a*. If matte treatment is performed by the formation of a textured pattern by texturing process, anti-reflective treatment can be applied to the flat platen 25 during molding. Furthermore, anti-reflective treatment can be applied to the flat platen 25 by forming the flat platen 25 integrally with the opening or the inclined plane 58*a*, 59*a*. The opening, the groove portion 58 having the inclined plane 58*a*, or the protrusion 59 having the inclined plane 59*a* can be integrally formed with the flat platen 25 in plastic molding.

According to the above embodiment, the ribs 52, 56 are provided such as to reduce the contact area between the surface 51 of the flat platen 25 and a sheet, enabling a provision that reduces a friction force between the sheet being fed and the flat platen 25, and enabling a provision that facilitates feeding of the sheet. The ribs 52, 56 may be integrally formed with the flat platen 25 in plastic molding.

According to the above embodiment, the ribs 52*b* protrude 2 mm or more from the surface 51 of the flat platen 25, thereby enabling a provision that reduces the amount of light that is emitted from the light emitting device, reflected at the ribs 52*b*, and finally received at the light receiving device.

In addition, no ribs are disposed directly under both side edges of a recording sheet or within 2 mm outward from positions directly under both side edges. Thus, at the time a recording sheet of a size that is often used is printed, the amount of light that is emitted from the light emitting device, reflected at the ribs, and finally received at the light receiving device can be reduced.

The ribs are made up of at least the two kinds of ribs 52, 56 of different heights. The high ribs 52 feed a recording sheet with a low friction, and the low ribs 56 carry the sheet that has absorbed ink during printing and partially bows to reduce bowing of the sheet. With these ribs, a provision that prevents deterioration of image quality is enabled.

What is claimed is:

1. An image forming apparatus, comprising:

an image forming device that forms an image on a recording sheet;

a surface that is disposed in a position opposite to a direction the image forming device forms an image and includes an area on which the recording sheet rests;

a sheet feeding device that feeds the recording sheet in a predetermined direction; and a side-edge detecting device having a light emitting device and a light receiving device that are disposed facing the recording sheet, the side edge detector detects a side edge of the recording sheet while moving in a direction perpendicular to the predetermined direction in order to emit light from the light emitting device, wherein at least an area irradiated with the light from the light emitting device is applied with an anti-reflective treatment that reduces an amount of light, emitted from the light emitting device, that is reflected on the surface and led to the receiving device.

2. The image forming apparatus according to claim 1, wherein the anti-reflective treatment applied to the surface is a matte treatment.

3. The image forming apparatus according to claim 2, wherein the matte treatment is texturing.

4. The image forming apparatus according to claim 1, wherein the anti-reflective treatment is a disposition of a light absorbent member on the surface.

5. The image forming apparatus according to claim 1, wherein the anti-reflective treatment is an opening in the surface.

6. The image forming apparatus according to claim 1, further comprising:

a contact area reducing member that reduces an area contacting the recording medium to be fed in the predetermined direction.

7. The image forming apparatus according to claim 6, wherein the contact area reducing member is a plurality of ribs that protrude from the surface.

8. The image forming apparatus according to claim 7, wherein the ribs protrude 2 mm or more from the surface.

9. The image forming apparatus according to claim 7, wherein the ribs are not disposed under a position extending vertically downwardly from a side edge of a standard-size recording medium to be fed.

10. The image forming apparatus according to claim 7, wherein the ribs are not disposed within 2 mm outward from the position extending vertically downwardly from a side edge of a standard-size recording medium to be fed.

11. The image forming apparatus according to claim 7, wherein the ribs are made up of at least two kinds of ribs of different heights.

12. The image forming apparatus according to claim 11, wherein a first kind of rib that has a lower height than a second kind of rib is closer to a side edge of a standard-size recording medium to be fed.

13. The image forming apparatus according to claim 6, wherein the contact area reducing member and the anti-reflective treatment are arranged on the surface in an area adapted to be passed over by the side edge detector.

14. The image forming apparatus according to claim 1, further comprising plates disposed between the surface and the side edge detector in order to prevent the recording medium from moving toward the side edge detector.

15. The image forming apparatus according to claim 1, wherein the anti-reflective treatment is processed on the surface at areas that correspond to a vicinity of a side edge of a standard-size recording medium to be fed.

16. The image forming apparatus according to claim 1, wherein the anti-reflective treatment is a groove having an inclined plane in the surface.

17. The image forming apparatus according to claim 1, wherein the anti-reflective treatment is a protrusion having an inclined plane in the surface.

* * * * *